US005478201A

United States Patent [19]

Amr

[11] Patent Number: 5,478,201

[45] Date of Patent: Dec. 26, 1995

[54] CENTRIFUGAL FAN INLET ORIFICE AND IMPELLER ASSEMBLY

[75] Inventor: Yehia M. Amr, Manlius, N.Y.

[73] Assignee: Carrier Corporation, Syracuse, N.Y.

[21] Appl. No.: 258,871

[22] Filed: Jun. 13, 1994

[51] Int. Cl.[6] ..... F04D 29/44; F04D 29/66

[52] U.S. Cl. ..... 415/206; 415/119; 415/208.1; 415/211.1; 415/220; 415/223; 416/186 R; 416/189; 416/203; 416/223 B

[58] Field of Search ..... 415/206, 208.1, 415/208.3, 208.2, 211.1, 220, 223, 119; 416/185, 186 R, 189, 192, 193 R, 203, 223 B

[56] References Cited

U.S. PATENT DOCUMENTS

| | | | |
|---|---|---|---|
| 4,253,800 | 3/1981 | Segawa et al. | 416/203 |
| 4,712,977 | 12/1987 | Gerfast | 415/208.2 |
| 4,971,520 | 11/1990 | Van Houten | 416/189 |
| 5,026,251 | 6/1991 | Kinoshita et al. . | |
| 5,066,194 | 11/1991 | Amr et al. . | |
| 5,215,437 | 6/1993 | TeVelde et al. . | |
| 5,215,438 | 6/1993 | Chou et al. | 415/223 |
| 5,244,347 | 9/1993 | Gallivan et al. | 416/189 |
| 5,248,224 | 9/1993 | Amr . | |
| 5,249,927 | 10/1993 | Vera | 416/189 |
| 5,273,400 | 11/1993 | Amr . | |

FOREIGN PATENT DOCUMENTS

| | | | |
|---|---|---|---|
| 1325267 | 3/1963 | France | 416/185 |
| 60799 | 3/1989 | Japan | 415/211.1 |

*Primary Examiner*—Edward K. Look
*Assistant Examiner*—Christopher Verdier

[57] ABSTRACT

An inlet orifice structure and impeller assembly for a centrifugal flow fan. The inlet orifice has an elliptical cross section in a plane passing through the axis of rotation of the fan. The impeller is shrouded and also has a similarly elliptical cross section. The impeller is sized so that, when assembled together, the shroud overlaps and rotates around the stationary inlet orifice. In a preferred embodiment, there are 13 impeller blades nonuniformly spaced around a hub plate. A particular blade spacing is disclosed and claimed. The inner surface of the hub plate is arcuately curved to guide the air flow through the fan from its entering axial direction to its radial exiting direction. The contour of the hub plate allows for the fan drive motor to be partially recessed into the plate.

13 Claims, 3 Drawing Sheets

CENTRIFUGAL FAN INLET ORIFICE AND IMPELLER ASSEMBLY

BACKGROUND OF THE INVENTION

This invention relates generally to fans for moving air. More particularly, the invention relates to an improved inlet orifice structure and centrifugal flow fan impeller assembly.

Centrifugal flow fans and their associated inlet orifices are widely used in a number of applications in the field of heating, ventilation and air conditioning (HVAC). Important objectives in the design and manufacture of HVAC systems and components are to minimize size, optimize air flow rates and minimize radiated noise.

In operation, air enters a centrifugal flow fan generally along the fan's axis of rotation, undergoes a change of flow direction within the fan and exits the fan radially. Depending on the application, the air may discharge through 360 degrees around the fan or a scroll with one or more outlets may surround the fan impeller to direct the discharge air in one or more specific directions. In HVAC applications, an electric motor usually drives the fan impeller. Stationary inlet orifices guide the incoming air into the fan suction.

To achieve size and performance objectives, it is important to minimize nonuniform flow and flow separation as the air flows through the fan.

SUMMARY OF THE INVENTION

The present invention is an inlet orifice structure and centrifugal fan impeller assembly. The assembly promotes an attached boundary layer throughout the air flow path through the fan. The fan impeller also has a blade configuration that minimizes tonal noise associated with the periodic passage of blades. The fan thus has improved efficiency and reduced noise while it produces the same air flow rate as a prior art fan of similar size.

In a plane normal to the axis of rotation of the fan, the inlet orifice structure is circular in cross section. In a plane passing through the axis of rotation of the fan, the orifice has an elliptical cross section.

Each impeller blade has a curved chord, is backwardly swept with respect to the direction of fan rotation and fixed to a base plate. Optimum performance is achieved with the number of impeller blades being equal to a prime number greater than six. In a preferred embodiment, there are 13 impeller blades.

The base plate inner face is generally arcuately contoured from its center toward its outer circumference so that there is space for a recessed motor enclosure within the base plate. The arcuate contour assists air flowing through the fan to transition smoothly from an axial direction as the air enters to a radial direction as it exits the fan.

There is a circular shroud fixed to the tips of the impeller blades. In a plane passing through the axis of rotation of the fan, the shroud has an elliptical inner cross section. The shroud is sized and positioned so that it overlaps but can freely rotate about the stationary inlet orifice.

The angular blade-to-blade spacing is nonuniform but the blade spacing is such that the impeller is statically and dynamically balanced.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
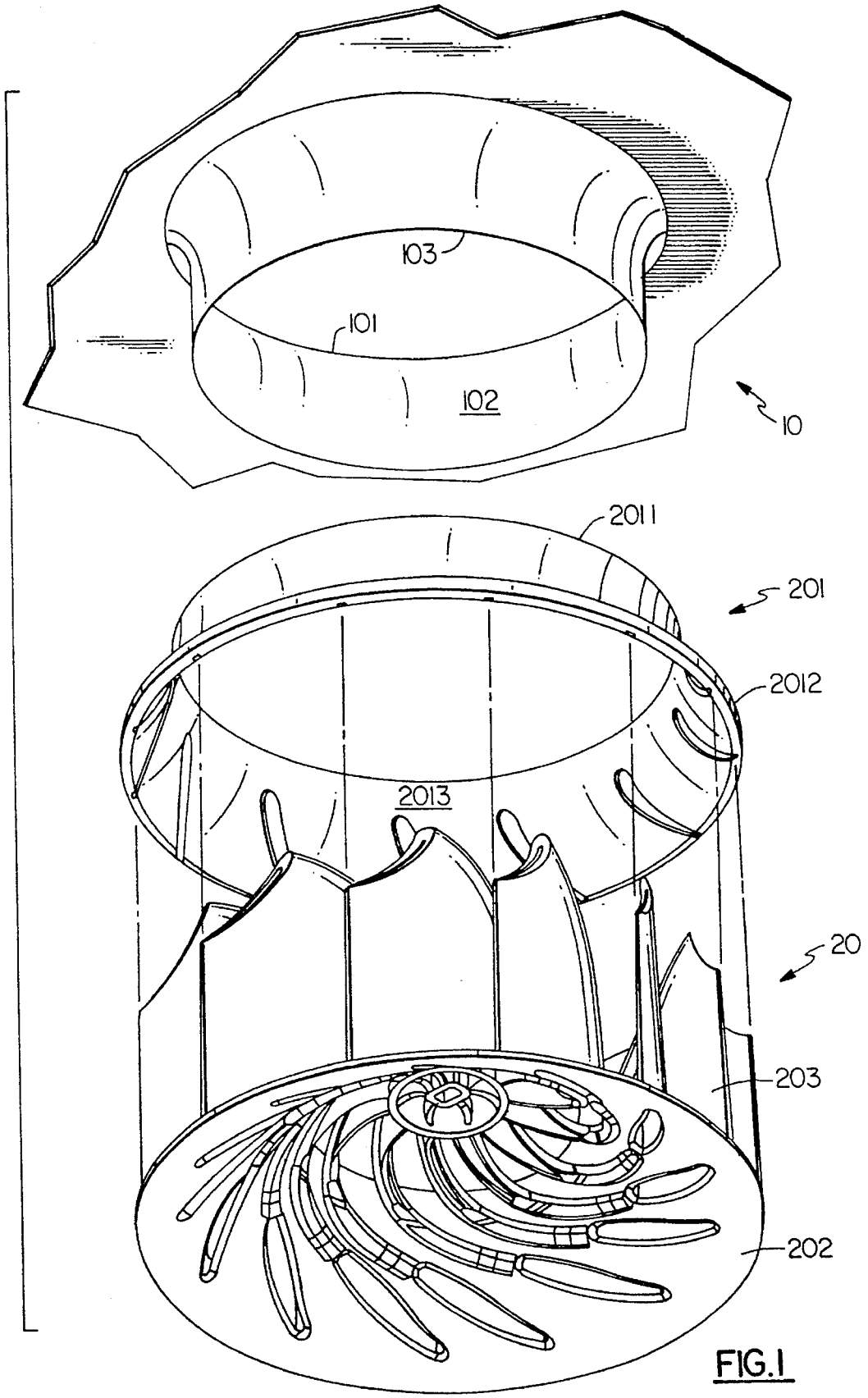
FIG. 1 is an exploded perspective view of the inlet orifice structure and centrifugal flow fan impeller of the present invention.
Figure 3:
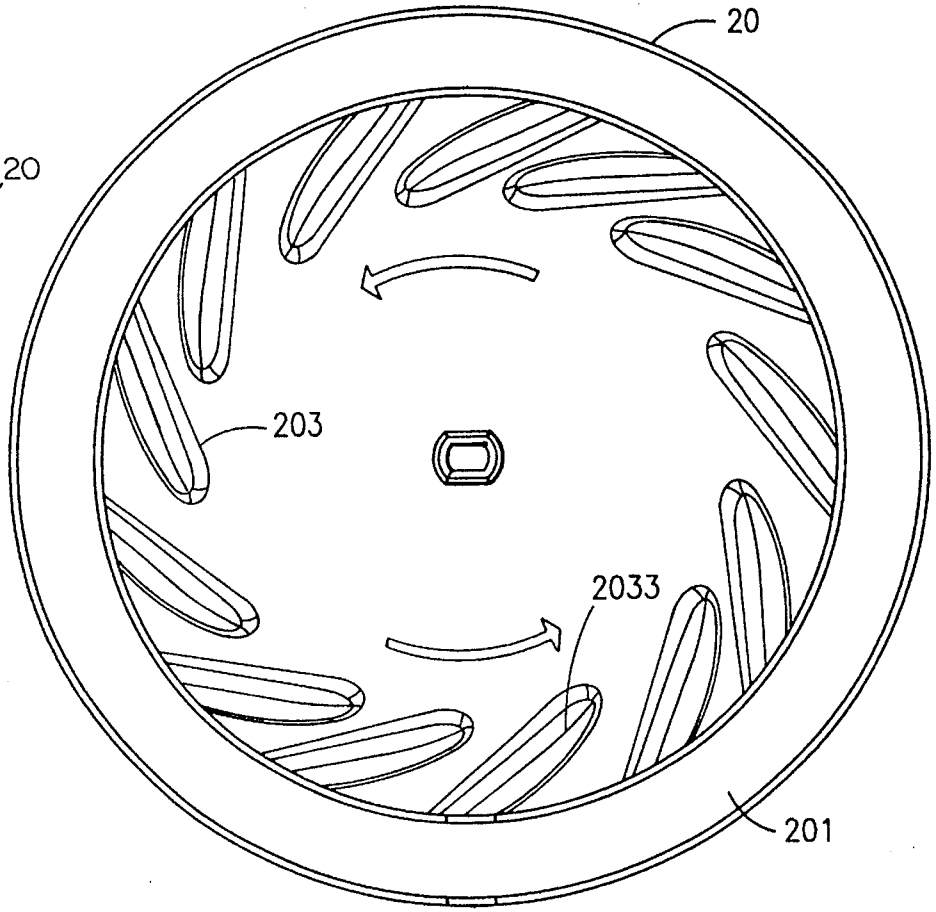
FIG. 3 is a top plan view of the fan impeller of the present invention.
Figure 2:
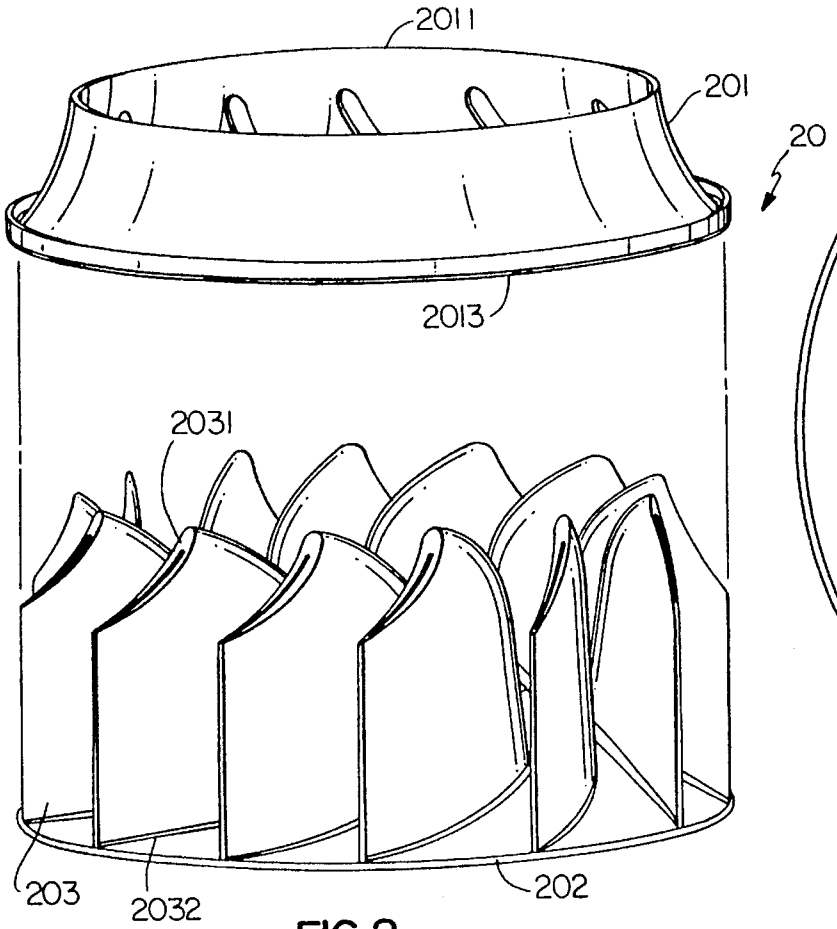
FIG. 2 is an exploded perspective view of the fan impeller of the present invention.

FIG. 1, in an exploded perspective view, shows the inlet orifice structure and fan impeller of the present invention. Circular orifice structure 10 has leading edge 101, throat 102 and trailing edge 103. Fan impeller 20 has blades 203 attached to hub plate 202. Shroud 201, when assembled, is attached to blades 203. Shroud 201 has leading edge 2011, trailing edge 2012 and diffuser 2013. FIG. 2 is another exploded perspective view of just fan impeller 20 and illustrates the attachment of blades 203 to hub plate 202 at blade roots 2032 and the attachment of shroud 201 to blade tips 2031. FIG. 3 is a top plan view of fan impeller 20 and illustrates curvilinear blade chord 2033.

Figure 4:
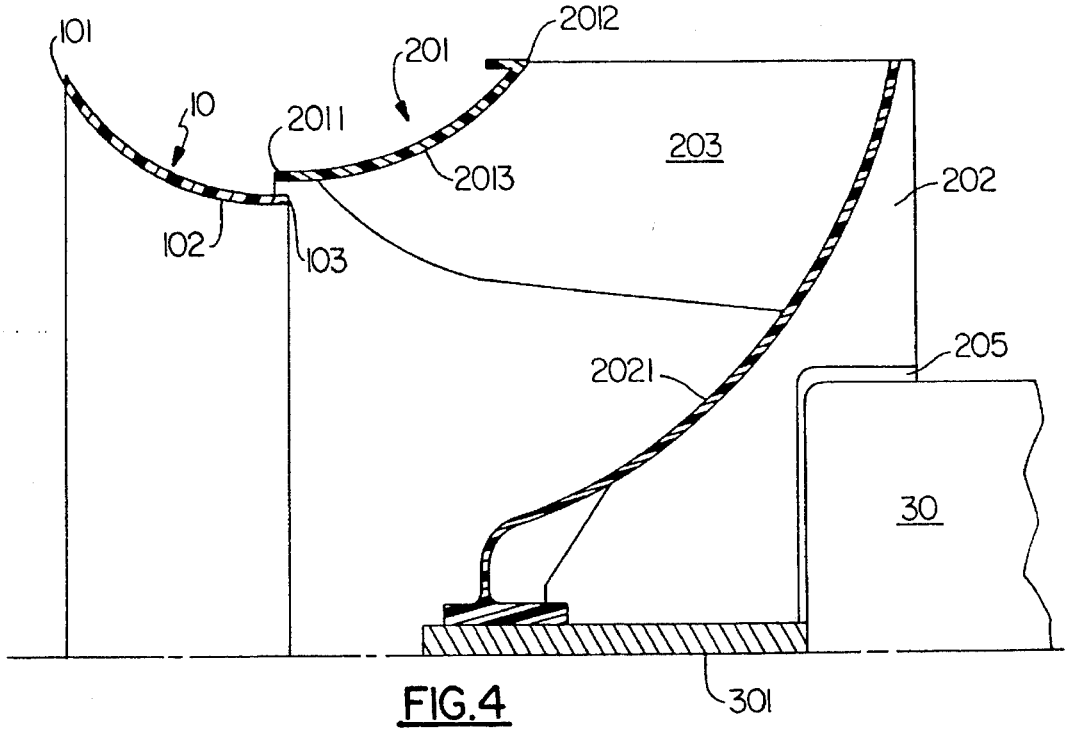
FIG. 4 is a sectioned partial elevation view of the inlet orifice structure and fan impeller of the present invention.

FIG. 4 is a partial sectioned elevation view of orifice structure 10 and fan impeller 20 as the two components would be assembled for operation. This figure shows elliptical orifice throat 102 extending from orifice leading edge 101 to orifice trailing edge 103. Elliptical diffuser 2013 of shroud 201 extends from shroud leading edge 2011 to shroud trailing edge 2012. Note that the inner radius of diffuser 2013 at leading edge 2011 is sufficiently large so that diffuser 2013 can overlap orifice 10 yet freely rotate when the fan is in operation. Because of this overlap, any air flow through the annular gap between orifice and shroud will be in the same general direction as the main flow of air entering the fan through the orifice and will not disturb the main flow. Hub plate 202 has curvilinear inner surface 2021 to which blades 203 are attached. Because of the shape of inner surface 2021, there is room for motor recess 205 that partially houses motor 30. Motor 30 drives fan impeller 20 through motor shaft 301.

Figure 5:
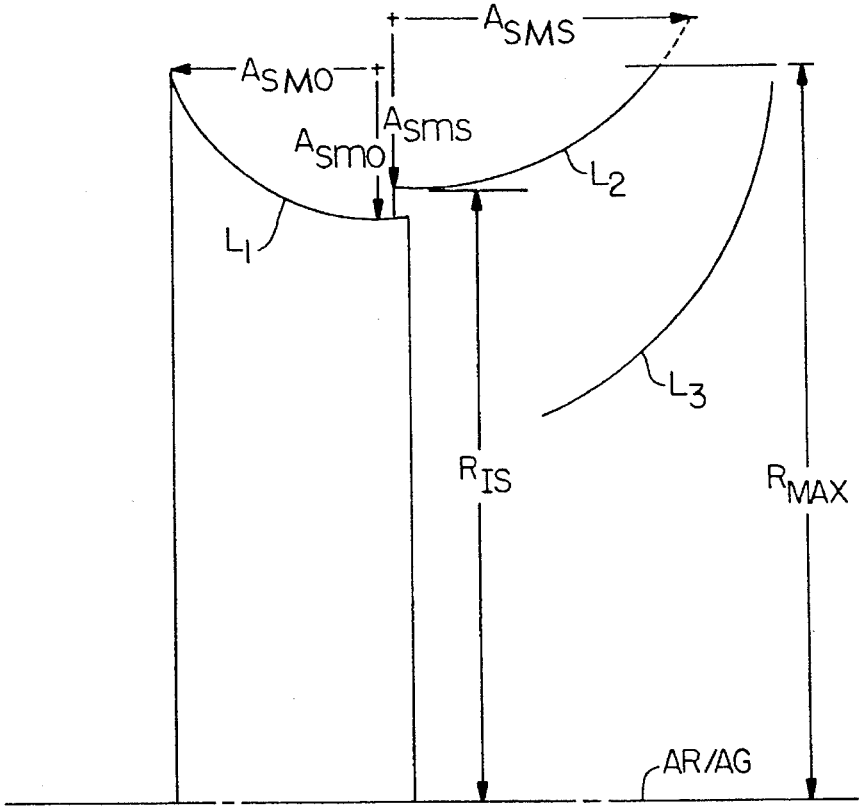
FIG. 5 is a diagram illustrating some of the geometric features and relationships in and among components of the present invention.

FIG. 5 illustrates the geometric features of and relationships among the components of a preferred embodiment of the orifice structure and fan impeller of the present invention. Throat 102 of orifice 10 is in form like the surface generated by rotating planar line $L_1$ about axis of generation $A_G$. Line $L_1$ is a quarter section of an ellipse having semimajor axis $A_{SMO}$, substantially parallel to axis of generation $A_G$, and semiminor axis $A_{SmO}$. Diffuser 201 of shroud 20 is in form like the surface generated by rotating planar line $L_2$ about axis of generation $A_G$. Axis of generation $A_G$ is coincident with fan axis of rotation $A_R$. Line $L_2$ is a quarter section of an ellipse having semimajor axis $A_{SMS}$, substantially parallel to axis of generation $A_G$, and semiminor axis $A_{SmS}$.

The minimum swept radius of diffuser 2013 is $R_{IS}$. The maximum swept radius of impeller 20 is $R_{MAX}$. Inner surface 2021 of hub plate 212 is in form like the surface generated by rotation planar line $L_3$ about axis of generation $A_G$. Line $L_3$ is the arc of a circle.

Theoretical work confirmed by prototype testing has indicated that the ratio of semimajor to semiminor axes of the ellipse of which line $L_1$ is a section should be at least 1.2, or $$A_{SMO}/A_{SmO} \geqq 1.2$$

and that a ratio of 1.4 provides excellent performance.

Such work also indicates that the ratio of the semiminor axis of the ellipse of which line $L_1$ is a section to the maximum swept radius of the fan impeller should be at least 0.14, or $$A_{SmO}/R_{MAX} \geqq 0.14$$

and that a ratio of 0.20 provides excellent performance.

Similarly, the ratio of semimajor to semiminor axes of the ellipse of which line $L_2$ is a section should be at least 1.2, or $$A_{SMS}/A_{SmS} \geqq 1.2$$

and that a ratio of 1.64 provides excellent performance.

And the ratio of the semiminor axis of the ellipse of which line $L_2$ is a section to the maximum swept radius of the fan impeller should be at least 0.25, or $$A_{SMS}/R_{MAX} \geqq 0.25$$

and that a ratio of 0.30 provides excellent performance.

The arc defined by line $L_3$ should extend for about 45° to 75° of the circumference of the circle of which it is an arc.

A major source of radiated noise from a fan is at the fundamental blade pass frequency ($F_{BP}$) and multiples of $F_{BP}$, with frequencies of two, three and four times $F_{BP}$ predominating. The blade pass frequency is the number of fan blades ($N_B$) multiplied by the rotational frequency ($F_R$) of the fan, or $$F_{BP}=N_B \times F_R.$$

The rotational frequency is related to the rotational speed at which the fan impeller turns. In a fan with uniform blade spacing, the discrete blade noise is a narrow band tone at $F_{BP}$ and its harmonics. For example, the blade tonal noise for a simple balanced two bladed axial fan is a tonal noise at a $F_{BP}$ equal to $2 \times F_R$. In fans having a larger number of blades, if the angular spacing between the blades is not a constant but varies, then the blade noise is not a discrete tone but is distributed over a band of frequencies about $F_{BP}$. Broadband noise is less offensive to most listeners than tonal noise. Random blade to blade spacing would provide the widest blade frequency band but completely random spacing might result in impeller static or dynamic imbalance. Even if the fan is balanced and tones at $F_{BP}$ are reduced, there can be other, new tones at lower frequencies.

Another source of radiated noise from a fan is air flow interaction or coherence between the impeller blades and other fan structural members or other structural members within the apparatus housing the fan. Since most manufactured structures tend to have regular features, a fan impeller with a prime number of blades would produce less coherence noise.

The fan impeller of the present invention thus has a prime number of blades and a blade-to-blade spacing that is not strictly random but is also not uniform. The number of blades should be a prime number greater than six. In a preferred embodiment, the number of blades is 13.

Impeller static and dynamic balance is achieved by insuring that both the sum of the sines and the sum of the cosines of the angular displacements of a similar point on particular blades from a reference point are as nearly equal to zero as is possible. In an iterative process, I have arrived at the following blade spacing for an embodiment having 13 blades that produces the desired results. In the table, β is the angular displacement of a similar point on a particular blade from a reference point and α is the angular spacing between similar points on two adjacent blades:

| Blade Number | α(°) | β(°) | sinβ | cosβ |
|---|---|---|---|---|
| 1 | | 28.25 | 0.4733 | 0.8809 |
| | 31.85 | | | |
| 2 | | 60.1 | 0.8669 | 0.4985 |
| | 24 | | | |
| 3 | | 84.1 | 0.9947 | 0.1028 |
| | 30.25 | | | |
| 4 | | 114.35 | 0.9110 | −0.4123 |
| | 31 | | | |
| 5 | | 145.35 | 0.5686 | −0.8226 |
| | 24.9 | | | |
| 6 | | 170.25 | 0.1693 | −0.9856 |
| | 22.75 | | | |
| 7 | | 193 | −0.2250 | −0.9744 |
| | 28.25 | | | |
| 8 | | 221.25 | −0.6593 | −0.7518 |
| | 32.15 | | | |
| 9 | | 253.4 | −0.9583 | −0.2857 |
| | 27.25 | | | |
| 10 | | 280.65 | −0.9828 | 0.1848 |
| | 29.5 | | | |
| 11 | | 310.15 | −0.7644 | 0.6448 |
| | 26.6 | | | |
| 12 | | 336.75 | −0.3947 | 0.9188 |
| | 23.25 | | | |
| 13 | | 0 | 0.0000 | 1.0000 |
| | 28.25 | | | |
| 1 | | | | |
| Sum | 360 | | −0.0006 | −0.0018 |

I have tested a prototype orifice structure and fan impeller embodying my invention. The prototype impeller produces the same air flow as a prior art fan of similar size when rotating at about a ten percent lower speed. The prototype is 6.7 dBA quieter and radiated acoustic energy is 78 percent less when compared to a prior art fan. The fan produces no tones at the blade pass frequency nor at higher or lower harmonics. The sound power level decreases at a rate of four to five dB/octave from 125 to 2000 Hz, so that the fan has a very low perceived loudness.

My invention is intended for use in the ceiling mounted inside heat exchanger of a residential duct-free "split" air conditioning system. Such a system is of the vapor compression type where the compressor, condenser and condenser fan are located in an enclosure outside the building structure and evaporator and evaporator fan(s) are located in the spaces (rooms) to be cooled, obviating the need for inside ducting to supply cooled air to spaces from a central evaporator and fan unit. A centrifugal fan embodying the teachings of the present invention, however, could be used in any application where such a fan is appropriate.

I claim:

1. An apparatus for moving air comprising:

an inlet orifice structure (10) comprising a surface having an axisymmetric orifice leading edge (101), an axisymmetric throat (102) in downstream air flow relationship with said orifice leading edge and extending from said leading edge to an orifice trailing edge (103), said throat being in form like a surface produced by rotating a first planar line ($L_1$) about a coplanar axis of generation ($A_G$), said first planar line being a generally quarter segment of a first ellipse having a major axis ($A_{SMO}$) that is substantially parallel to said axis of generation and a semiminor axis ($A_{SmO}$); and a fan impeller (20) of the centrifugal flow type having an axis of rotation ($A_G$) that is, when assembled for operation with said inlet orifice structure, coincident with said axis of generation of said orifice structure, an impeller hub plate (202) having an inner face (2021) and centered on said axis of rotation;

thirteen blades (203), each having a root (2031) and a tip (2032), and affixed at said root to and extending generally outward from said inner face, arranged with an angular spacing between similar points on adjacent blades of 31.85°, 24°, 30.25°, 31°, 24.9°, 22.75°, 28.25°, 32.15°, 27.25°, 29.5°, 26.6° 23.25° and 28.25°, backwardly swept with respect to a preferred direction of rotation of said impeller;

an axisymmetric orificed shroud (201) affixed to said blade tips and having a shroud leading edge (2011) and a shroud trailing edge (2012), with respect to air flow through said shroud orifice, a diffuser (2013) extending from said shroud leading edge to said shroud trailing edge, said diffuser being in form like a surface produced by rotating a second planar line ($L_2$) about a coplanar axis of generation that is coincident with said axis of rotation, said second planar line being a generally quarter segment of a second ellipse having a semimajor axis ($A_{SMS}$) substantially parallel to said axis of generation and a semiminor axis ($A_{SmS}$) and a portion of said diffuser adjacent said leading edge having an inner radius ($R_{IS}$) sufficient to allow, when said fan impeller and said inlet orifice structure are assembled for operation, said diffuser portion to overlap and freely rotate about said throat portion of said orifice structure.

2. The apparatus of claim 1 in which said semimajor axis of said first ellipse is at least 1.2 times said semiminor axis of said first ellipse.

3. The apparatus of claim 2 in which said semimajor axis of said first ellipse is 1.4 times said semiminor axis of said first ellipse.

4. The apparatus of claim 1 in which said impeller has a maximum swept radius ($R_{MAX}$) and said semiminor axis of said first ellipse is at least 0.14 times said maximum swept radius.

5. The apparatus of claim 4 in which said semiminor axis of said first ellipse is 0.20 times said maximum swept radius.

6. The apparatus of claim 1 in which said semimajor axis of said second ellipse is at least 1.2 times the semiminor axis of said second ellipse.

7. The apparatus of claim 6 in which said semimajor axis of said second ellipse is 1.64 times the semiminor axis of said second ellipse.

8. The apparatus of claim 1 in which said impeller has a maximum swept radius and said maximum swept radius is at least 0.25 times the semiminor axis of said second ellipse.

9. The apparatus of claim 8 in which the semiminor axis of said second ellipse is 0.30 times said maximum swept radius.

10. The apparatus of claim 1 in which said hub plate contains a motor enclosure.

11. The apparatus of claim 1 in which said inner faces of said hub plate has a contoured portion (2021) that in form like a surface produced by rotating a third planar line ($L_3$) about a coplanar axis of rotation that is coincident with said axis of rotation, said third planar line being an arc of a circle.

12. The apparatus of claim 1 in which said arc extends for 45 to 75 degrees of the circumference of said circle.

13. The apparatus of claim 1 in which said blades have a curved chord.

* * * * *